United States Patent [19]

Landry

[11] 4,069,806

[45] Jan. 24, 1978

[54] COLLAPSIBLE CAMP STOVE ASSEMBLY

[76] Inventor: Jean Landry, 124 Marie Victorin Blvd., Cote St. Catherine, County of Laprairie, Canada

[21] Appl. No.: 734,259

[22] Filed: Oct. 20, 1976

[51] Int. Cl.[2] ..... F24C 1/16; F24C 15/00

[52] U.S. Cl. ..... 126/9 R; 126/59; 126/301; 126/307 R

[58] Field of Search ..... 126/9 R, 59, 60, 64, 126/65, 29, 4, 38, 318, 307 R, 301; 285/189, 192, 194, 424

[56] References Cited

U.S. PATENT DOCUMENTS

| | | | |
|---|---|---|---|
| 37,043 | 12/1862 | Kingsland | 126/59 |
| 39,882 | 9/1863 | Bryant | 126/9 R |
| 143,120 | 9/1873 | Brinkerhoff | 126/318 |
| 1,540,073 | 6/1925 | Hugo et al. | 126/38 |
| 2,119,799 | 6/1938 | Sivey | 126/9 R |
| 3,032,027 | 5/1962 | Poyer | 126/9 R |
| 3,124,057 | 3/1964 | Kiser | 126/9 R X |
| 3,880,139 | 4/1975 | Young | 126/9 R |

FOREIGN PATENT DOCUMENTS

| | | | |
|---|---|---|---|
| 14,347 | 6/1910 | United Kingdom | 126/9 R |

*Primary Examiner*—William F. O'Dea
*Assistant Examiner*—Harold Joyce

[57] ABSTRACT

A collapsible camp stove assembly which is characterized by a lap and groove joint between the bottom and the sides and between the top and the sides such that these basic members do not need secondary members to form suitable joints and such as to form flame and smoke tight joints between these basic members. This collapsible camp stove is adapted to house all the flue sections and other stove accessories therein when in the collapsed mode. The collapsible camp stove assembly includes a bottom, a top and sides; the bottom and the top have peripheral flanges cooperatively engaging each other and forming an enclosure for the sides and other members when the stove is collapsed and the sides form lap and groove joints with the bottom and the top when the stove is installed.

2 Claims, 8 Drawing Figures

COLLAPSIBLE CAMP STOVE ASSEMBLY

This invention relates to a camp stove and, more particularly, to a camp stove assembly of the collapsible type to be easily portable, such as for camping and use in the bush.

The collapsible camp stoves which have been proposed so far are found lacking in one or more ways. For instance, the joints between the various members, such as the sides, top and bottom, are not flame- and smoke-tight and they bulge open under heat. Besides, in a search to make good joints, the previously proposed camp stoves are made with any secondary parts welded or otherwise secured to the basic parts; this adds to the cost and weight of the stoves.

It is a general object of the present invention to provide a collapsible camp stove assembly in which the stove is of simple construction and yet which is relatively flame- and smoke-tight at the joints between various members thereof.

It is another object of the present invention to provide a collapsible camp stove assembly wherein the joints are integrally formed by the basic components of the stove without additional secondary components.

It is a further object of the present invention to provide a collapsible camp stove assembly which includes many accessories for the stove all fitting in the latter when it is in the collapsed configuration.

The above and other objects and advantages of the present invention will be better understood with reference to the following detailed description of a preferred embodiment of the present invention which is illustrated, by way of example, in the accompanying drawings, wherein.

Figure 1:
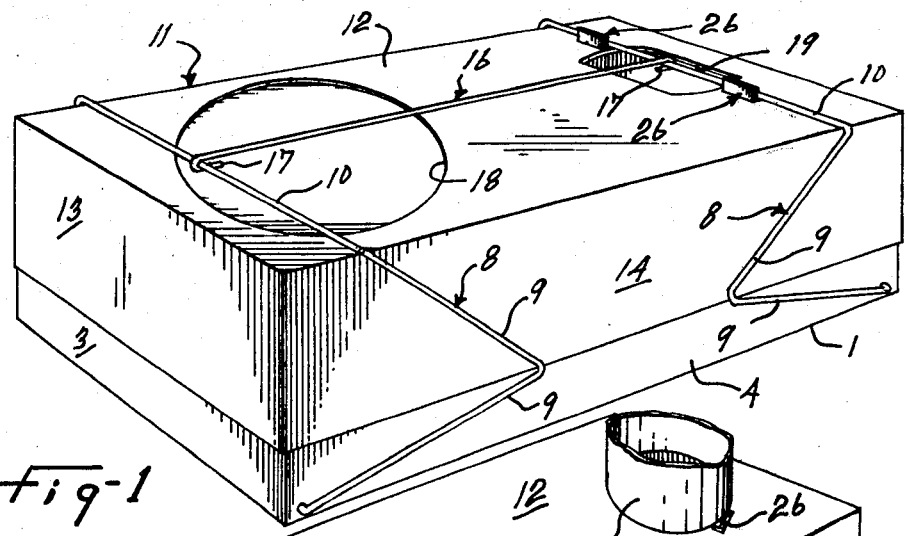
FIG. 1 is a perspective view of a collapsible camp stove assembly according to the present invention and shown in fully collapsed position.

The illustrated camp stove assembly comprises a camp stove which includes a bottom unit 1 having a flat bottom 2 and operatively upstanding side flanges 3, 4, 4, and 5 at the front, sides, and rear respectively thereof. These flanges are stamped from sheet metal integrally with the bottom 2 and are folded upward to form a tray, or receptacle, of rectangular outline and defining an open top. The front flange 3 is provided with an aperture 6 which is adjustably closed by an air draft regulator 7 pivotally sliding to adjustably shut this aperture.

A pair of bent wire legs 8 have their opposite ends pivotally engaged in the upstanding side flanges 4, 4 respectively. Each leg 8 includes a pair of elbows 9 separated by a straight transverse portion 10.

Figure 5:
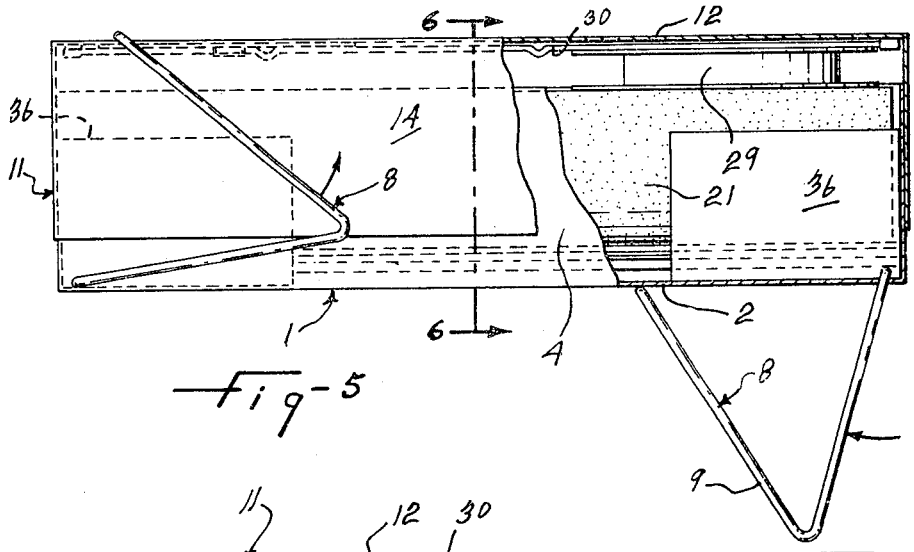
FIG. 5 is a side elevation view of the camp stove with parts broken away and the legs in different positions respectively.
Figure 6:
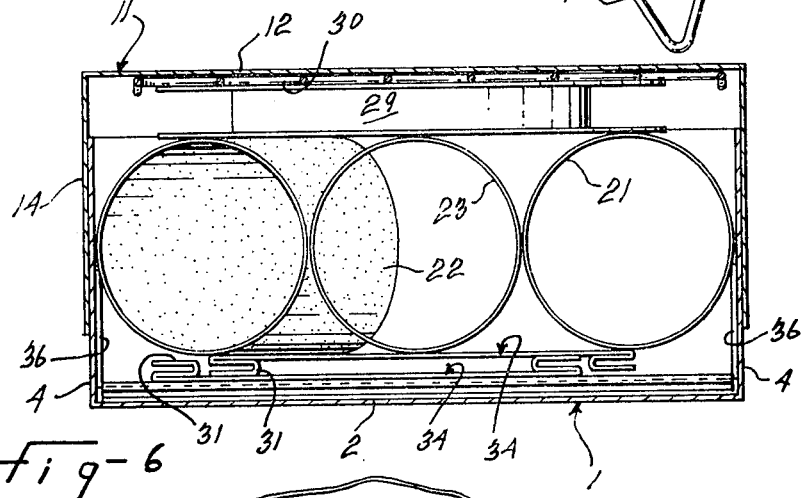
FIG. 6 is a transverse cross-sectional view through the camp stove as seen along line 6—6 in FIG. 5.

The cap stove also includes a top unit 11 having a top portion 12 and downwardly projecting side flanges 13, 14, 14, and 15 at the front, sides and rear respectively thereof. These flanges are stamped from sheet metal integrally with the top 12 and are folded operatively downwardly to form a peripherally flanged cover fitting around and in lateral overlapping engagement with the side flanges 3, 4, 4, and 5 of the bottom unit 1 upon closing of the stove, as shown in FIGS. 1, 5, and 6. In this closed position, the bottom and top units 1 and 11 cooperatively define an enclosed internal space in which are stored or placed all the hereinafter defined flue sections and stove components.

In this closed position, the legs 8 are pivoted upward for engagement of the transverse portions 10 over the top portion 12 of the top unit 11, as shown in FIGS. 1 and 5. A poker 16, made of a bent wire, is formed with a pair of hooks 17 at its opposite ends respectively operatively inter-hooking the two transverse portions 10 of the legs 8 to hold the latter and the camp stove in closed position.

Figure 2:
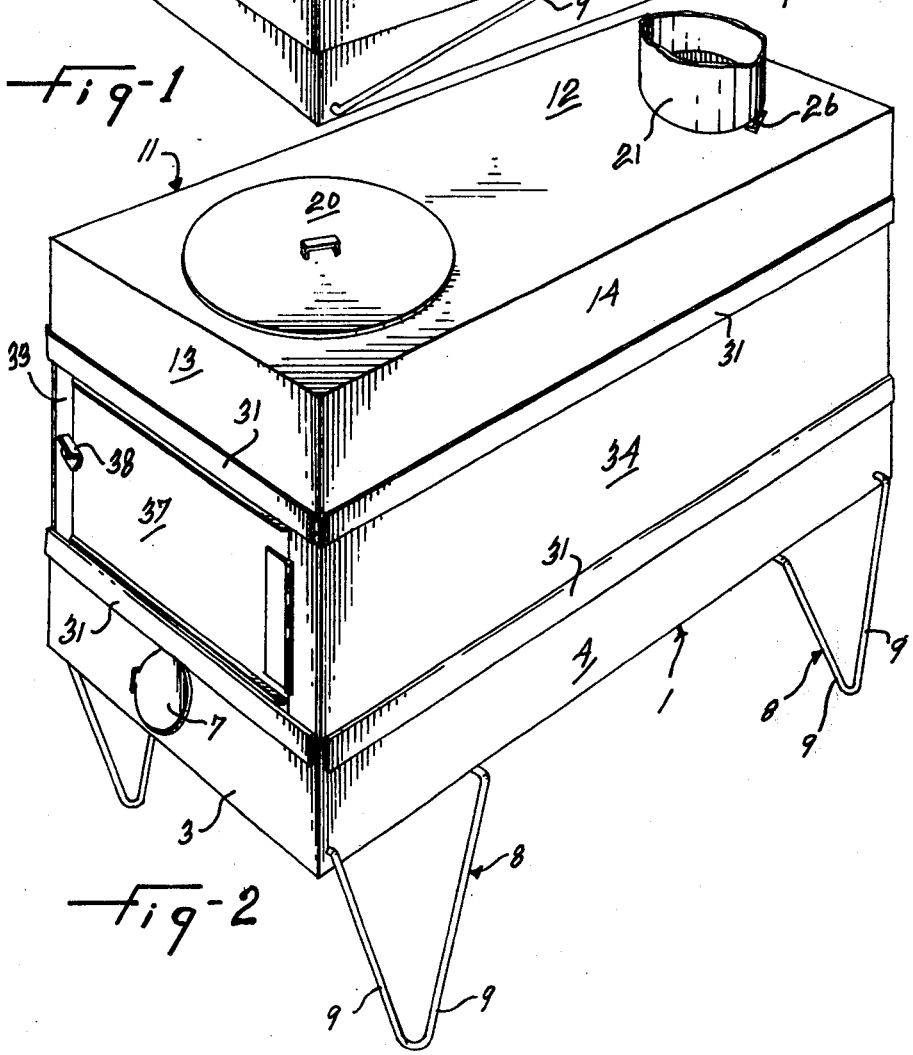
FIG. 2 is a perspective view of the stove assembly of FIG. 1, but this time in installed or operative position.

The top unit 11 has its top 12 provided with a circular aperture 18 at the front and a smoke outlet aperture 19 at the rear. The front aperture 18 may be used for direct-fire cooking or to put combustible elements in the stove. A circular cover, or disc 20, is normally used to close the front aperture 18, as shown in FIG. 2. Smoke outlet aperture 19 is rectangular in shape with straight opposite longitudinal side edges and arc-shaped opposite coaxial transverse side edges.

Figure 7:
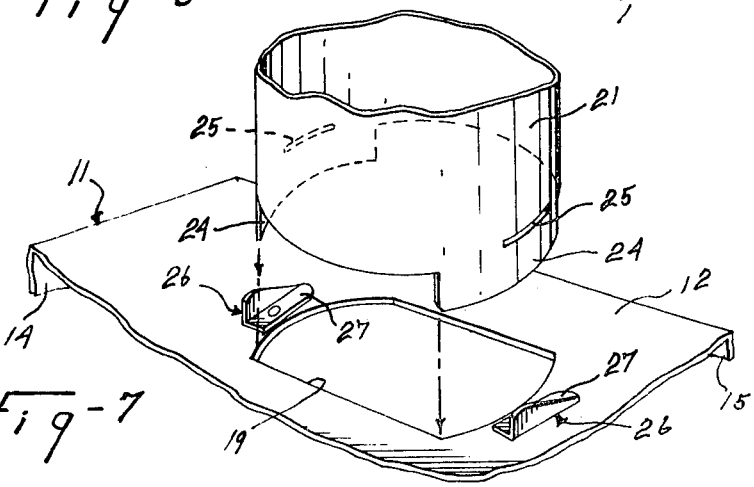
FIG. 7 is a perspective view illustrating the connection between the first flue section and the top of the camp stove.

Three flue sections 21, 22, and 23 are supplied with the camp stove assembly and inoperatively fit in the enclosed space cooperatively defined by the bottom unit 1 and top unit 11 in collapsed position, as aforedescribed. As best shown in FIG. 7, the bottom cylindrical flue section 21 is provided with a pair of diametrically opposite axial projections or lugs 24 which are formed to non-rotatably engage in the smoke outlet aperture 19. Lugs 24 fit against the arc-shaped transverse side edges of aperture 19, whereas the end edge portions of the flue section 21 intermediate lugs 24 abut against top 12. Thus, the flue gases within the stove can enter the flue section 21 while encountering a minimum of obstruction. A pair of circumferential slits 25 are formed at the inner end of the projections or lugs 24. A pair of sheet metal latches 26 are pivoted on the top 12 and formed each with a flat projection 27 operatively engaging in a corresponding circumferential slit 25 and, thus, locking the bottom flue section 23 in operative registry with the smoke outlet aperture 19 and prevents its upward movement. The flue section 22 is an elbow while the flue section 23 is a straight section operatively extending horizontally through a wall of a shelter such as the tent 28.

Since the camp stove assembly is adapted to be used inside a tent 28, as well as in other types of shelters, it includes an annular fire shield 29 operatively forming a shield at the passage of the flue section 23 through the wall of the tent. A screen 30 is also provided to be placed at the outlet end of the flue section 23 and, thus, protects the surrounding against burning ashes flying out of the flue.

Figure 3:
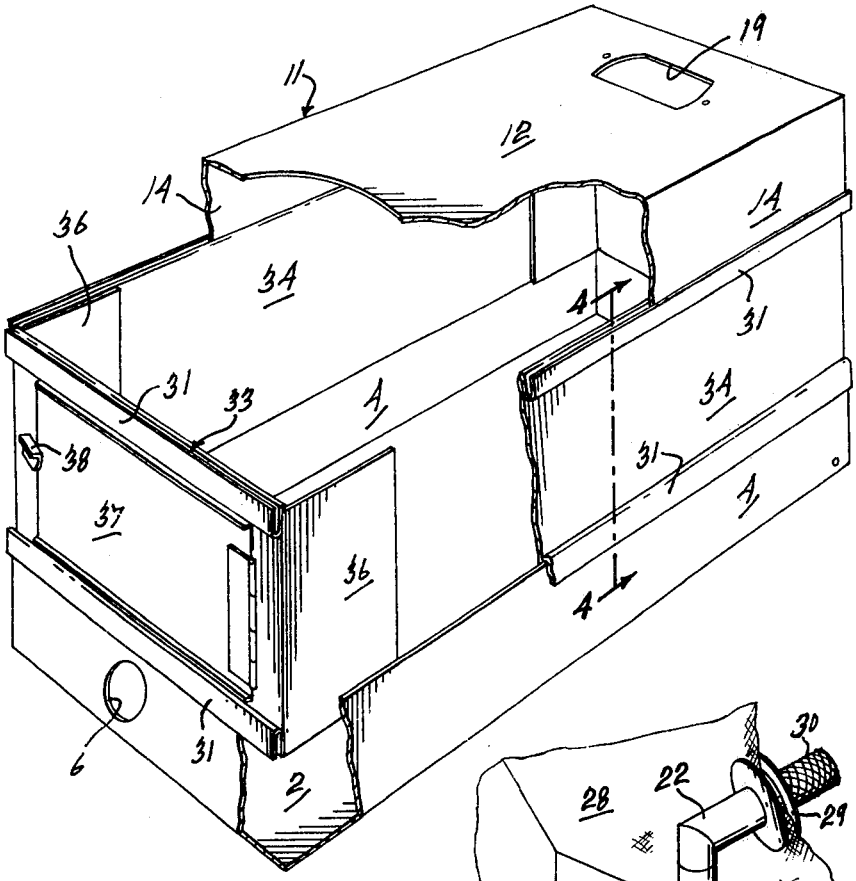
FIG. 3 is a perspective view of the camp stove as in FIG. 2 but with parts broken away to show details of construction.
Figure 4:
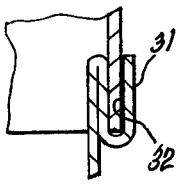
FIG. 4 is a cross-sectional view of lap and groove joints as seen along line 4—4 in FIG. 3.
Figure 8:
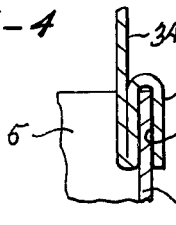
FIG. 8, on the same sheet of drawings as FIGS. 3 and 4, is a perspective view of the whole camp stove assembly operatively installed in a tent.
Figure 8:
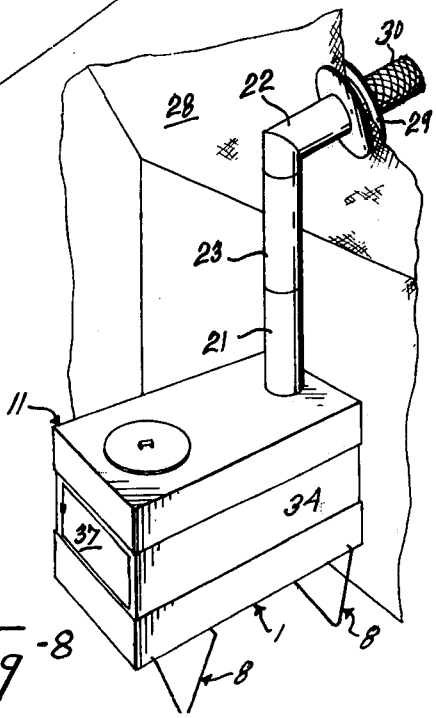

The collapsible camp stove also includes side units 33, 34, 34, and 35 adapted to form the front panel, the side panels and the real panels respectively of the stove intermediate the bottom unit 1 and the top unit 11. As best shown in FIGS. 3 and 4, each of the bottom and top edges of each side unit 33, 34, 34, and 35 forms a lap and groove joint with the corresponding side flange of either the bottom unit 1 or the top unit 11. More particularly, this lap and groove joint is formed by a transversely folded edge portion 31 of the corresponding side unit 33, 34, 34 or 35 and the corresponding side flange engaged edgewise in the groove 32 formed by the same folded edge portion. Thus, along each bottom and top edges of each side unit, there is a transversely folded edge portion 31 forming a groove 32 extending longitudinally of the corresponding side unit and adapted to form a flame and smoke-tight lap and groove joint with one of the afore-mentioned side flanges 3, 4, 4, 5, 13, 14, 14, and 15.

Each of the front and rear side plates, or units 33 and 35, is formed with side wings 36 at the opposite ends respectively thereof to make a tight joint between the two cooperating side units at each corner of the stove, as best seen in FIG. 3. The front panel unit 33 is provided with a hinged floor 37 and a latch 38 to provide access to feed wood and the like combustible material in the stove.

As shown in FIGS. 5 and 6, all the auxiliary flue sections 21, 22, and 23 and other stove components 29 and 30 fit in the enclosed spaced defined by the top unit 11 in closed position over the bottom unit 1. The side units 33, 34, 34, and 35 also fit in the same space to form a compact and portable stove assembly.

It must be noted that the afore-mentioned units forming the stove are of simple sheet metal construction free of secondary parts to form the joints between them.

More flue sections may be supplied with the stove assembly, if disassembled at the seam to be piled one on the other.

Other changes in the details of construction may be made without departing from the spirit and scope of the invention as defined by the appended claims.

What I claim is:

1. A collapsible camp stove assembly comprising a sheet metal bottom unit having operatively upstanding side flanges and an open top, a sheet metal top unit having an open bottom and downwardly projecting side flanges fitting in lateral overlapping engagement with said upstanding side flanges in the closed position of the top unit over the bottom unit, sheet metal side units operatively defining bottom and top edges each cooperatively forming a lap and groove joint with one of said side flanges, and auxiliary fine sections and stove components collapsibly fitting with the sheet metal side units in the internal space cooperatively confined by said bottom unit and top unit upon resting of the latter in closed position over the bottom unit, said top unit including a rectangular shape smoke outlet aperture with straight opposite longitudinal side edges and arc-shaped opposite coaxial transverse side edges, one of said flue sections having one end provided with a pair of diametrically opposite axial lugs defining intermediate end edge portions of said flue section, said flue section, when connected to said smoke outlet aperture, having said end edge portions abutting against said top unit, said lugs non-rotatably engaging with said smoke outlet aperture and fitting against the arc-shaped transverse side edges of said aperture, said lugs each provided with a cicumferentially extending slit made therein and above the level of said top unit and latches pivotally carried by said top unit and each including a flat projection removably engaging into said slit respectively to releasably fix said one flue section within said smoke outlet aperture.

2. A collapsible camp stove assembly as defined in claim 1, further including a pair of bent wire legs and a bent wire poker having a pair of hooks at the opposite ends respectively thereof with said poker inter-hooking said bent wire legs with the latter in closed position with said poker over said top unit and with said hooks releasably engaging said bent wire legs respectively.

* * * * *